US010508629B2

(12) United States Patent
Nakawatase et al.

(10) Patent No.: US 10,508,629 B2
(45) Date of Patent: Dec. 17, 2019

(54) ASSEMBLING STRUCTURE FOR INTAKE MANIFOLD

(71) Applicant: TOYOTA JIDOSHA KABUSHIKI KAISHA, Aichi-ken (JP)

(72) Inventors: Akira Nakawatase, Toyota (JP); Hiroki Matsui, Toyota (JP); Yuki Amamoto, Toyota (JP); Takaaki Nakazono, Nagakute (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/059,613

(22) Filed: Aug. 9, 2018

(65) Prior Publication Data

US 2019/0128225 A1 May 2, 2019

(30) Foreign Application Priority Data

Oct. 27, 2017 (JP) ..... 2017-208297

(51) Int. Cl.

| | |
|---|---|
| ***F02M 35/116*** | (2006.01) |
| ***F02M 35/10*** | (2006.01) |
| ***F02B 75/22*** | (2006.01) |
| *F02B 75/18* | (2006.01) |

(52) U.S. Cl.

CPC ..... *F02M 35/116* (2013.01); *F02B 75/22* (2013.01); *F02M 35/10085* (2013.01); *F02M 35/10354* (2013.01); *F02B 2075/1824* (2013.01)

(58) Field of Classification Search

CPC ..... F02M 35/116; F02M 35/10354; F02M 35/10085; F02M 35/1034; F02B 75/22; F02B 2075/1824; F01B 1/04

See application file for complete search history.

(56) References Cited

U.S. PATENT DOCUMENTS 2,260,309 A * 10/1941 Funderburk ..... F02M 1/00 123/556
2,941,521 A * 6/1960 Shrimpton ..... F02F 1/38 123/41.82 R
2,991,774 A * 7/1961 Rarey ..... F02F 7/006 123/54.7
3,018,767 A * 1/1962 Sailler ..... F02M 1/00 123/547

(Continued)

FOREIGN PATENT DOCUMENTS

| | | | |
|---|---|---|---|
| JP | H01-110860 | A | 4/1989 |
| JP | H04-134168 | A | 5/1992 |
| JP | 2010-190230 | A | 9/2010 |

*Primary Examiner* — Grant Moubry
*Assistant Examiner* — James G Moubry
(74) *Attorney, Agent, or Firm* — Hauptman Ham, LLP

(57) ABSTRACT

An assembling structure for an intake manifold includes: a first downstream portion; a second downstream portion; an upstream portion; a connecting member that connects the first downstream portion and the second downstream portion with each other; and a plate-shaped stay. The connecting member is fixed to the first downstream portion and the second downstream portion by a bolt, and an other member that is a member other than the intake manifold is fixed to the intake manifold through the stay at least either between the connecting member and the first downstream portion, or between the connecting member and the second downstream portion.

5 Claims, 4 Drawing Sheets

(56) References Cited

U.S. PATENT DOCUMENTS

| | | | | | |
|---|---|---|---|---|---|
| 4,210,107 | A * | 7/1980 | Shaffer | F02B 27/02 | 123/184.34 |
| 4,872,424 | A * | 10/1989 | Carnes | F02M 35/10039 | 123/184.32 |
| 5,392,751 | A * | 2/1995 | Matsubara | F02B 37/02 | 123/559.1 |
| 5,544,629 | A * | 8/1996 | Ohata | F02B 75/22 | 123/184.36 |
| 6,067,949 | A * | 5/2000 | Hughes | F02B 61/02 | 123/184.24 |
| 6,904,885 | B2 * | 6/2005 | Osband | F02B 75/22 | 123/190.1 |
| 8,210,146 | B2 * | 7/2012 | Horie | F02M 35/10085 | 123/184.31 |
| 8,267,070 | B2 * | 9/2012 | Nakawatase | F02M 35/10104 | 123/568.15 |
| 9,995,255 | B2 * | 6/2018 | Gruschow | F02M 35/10288 | |
| 10,240,564 | B2 * | 3/2019 | Nakamura | F02M 35/116 | |
| 2002/0189567 | A1 * | 12/2002 | Ikuma | F02M 35/10039 | 123/184.34 |
| 2008/0313904 | A1 * | 12/2008 | Peffley | F02M 35/10321 | 29/890.08 |
| 2009/0293831 | A1 * | 12/2009 | Harada | F02M 35/10085 | 123/184.53 |

* cited by examiner

ASSEMBLING STRUCTURE FOR INTAKE MANIFOLD

INCORPORATION BY REFERENCE

The disclosure of Japanese Patent Application No. 2017-208297 filed on Oct. 27, 2017 including the specification, drawings and abstract is incorporated herein by reference in its entirety.

BACKGROUND

1. Technical Field

The disclosure relates to an assembling structure for an intake manifold.

2. Description of Related Art

An internal combustion engine described in Japanese Unexamined Patent Application Publication No. 4-134168 (JP 4-134168 A) is a so-called V-shaped internal combustion engine, and a pair of cylinder heads is attached to an upper surface of a cylinder block. In the internal combustion engine described in JP 4-134168 A, the cylinder head on one bank side and the cylinder head on the other bank-side are connected with each other by a plate-shaped connecting member.

SUMMARY

Like the internal combustion engine described in JP 4-134168 A, when a member that structures one bank, and a member that structures the other bank are connected with each other by a connecting member for reinforcement, the connecting member is required to have appropriate rigidity. Therefore, if there are manufacturing errors in shapes and dimensions of a member to which the connecting member is fixed (the cylinder head in the case of the internal combustion engine described in JP 4-134168 A) and the connecting member, it is difficult to absorb the errors by deformation of the connecting member. Therefore, assembly becomes difficult when the connecting member is fixed, and it is more likely that rattling and so on happen even when the assembly is done.

An example aspect of the disclosure is an assembling structure for an intake manifold that is provided between a first cylinder head on a first bank-side and a second cylinder head on a second bank-side in a V-shaped internal combustion engine and is configured to supply intake air from outside to a first suction port of the first cylinder head and a second suction port of the second cylinder head. The assembling structure includes: a first downstream portion including a first downstream passage connected with the first suction port, the first downstream portion being connected with the first cylinder head; a second downstream portion including a second downstream passage connected with the second suction port, the second downstream portion being connected with the second cylinder head; an upstream portion including a first upstream passage and a second upstream passage, the upstream portion being connected with upstream sides of the first downstream portion and the second downstream portion in an intake airflow direction, the first upstream passage communicating with the first downstream passage, the second upstream passage communicating with the second downstream passage, a connecting member that connects the first downstream portion and the second downstream portion with each other; and a plate-shaped stay. The connecting member is fixed to the first downstream portion and the second downstream portion by a bolt, and an other member that is a member other than the intake manifold is fixed to the intake manifold through the stay at least either between the connecting member and the first downstream portion, or between the connecting member and the second downstream portion.

With the structure, when the connecting member is fixed to the first downstream portion and the second downstream portion by a bolt, deformation and so on of the stay interposed between the connecting member and the first downstream portion or the second downstream portion is able to absorb errors in shape and dimension of the connecting member and so on. This means that the stay also functions as a washer. Therefore, it is possible to restrain deterioration of assembly performance of the connecting member and each of the downstream portions, and rattling after the assembly. Moreover, the stay is also used to fix the other member to the intake manifold, and it is thus not necessary to add a new member just to restrain deterioration of assembly performance of the connecting member. Therefore, it is possible to minimize an increase in the number of parts and an increase in assembly man-hours.

The stay may include a first stay and a second stay and the first downstream portion may be fixed to each other at a plurality of places, the connecting member and the second downstream portion may be fixed to each other at a plurality of places, the first stay may be interposed at one of the fixed places between the connecting member and the first downstream portion may be interposed in the fixed place between the connecting member and the second downstream portion may be disposed at the fixed place that is the farthest from the first stay.

With the structure, dimension errors are absorbed by the stays located at the two farthest places where dimensional errors tend to become large. Therefore, compared to a case where dimensional errors are absorbed at two places that are adjacent to one another, deterioration of assembly performance and rattling after the assembly are restrained in a more favorable manner.

A material of the first downstream portion and the second downstream portion may be higher rigidity than that of a material of the upstream portion may be the same as the material of the first downstream portion and the second downstream portion.

With the structure, rigidity of the first downstream portion and the second downstream portion is relatively high, and rigidity of the connecting member is also high similarly to the first downstream portion and the second downstream portion. Therefore, it is not possible to expect that manufacturing errors in shape and dimension are absorbed by deformation of each of the downstream portions or the connecting member. In such a structure, it is extremely preferred that the stay is interposed so that deformation of the stay absorbs manufacturing errors in shape and dimension.

The other member may be a purge pipe that introduces evaporated fuel to an intake system of the internal combustion engine. In the structure, since the stay is interposed between the connecting member and the first downstream portion or the second downstream portion, the stay and the other member are fixed to the intake manifold strongly. It is preferred to use such a strong fixing structure for the purge pipe that is a long member prone to vibration and bending.

The upstream side in the intake airflow direction may be one side of a thickness direction of the intake manifold.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
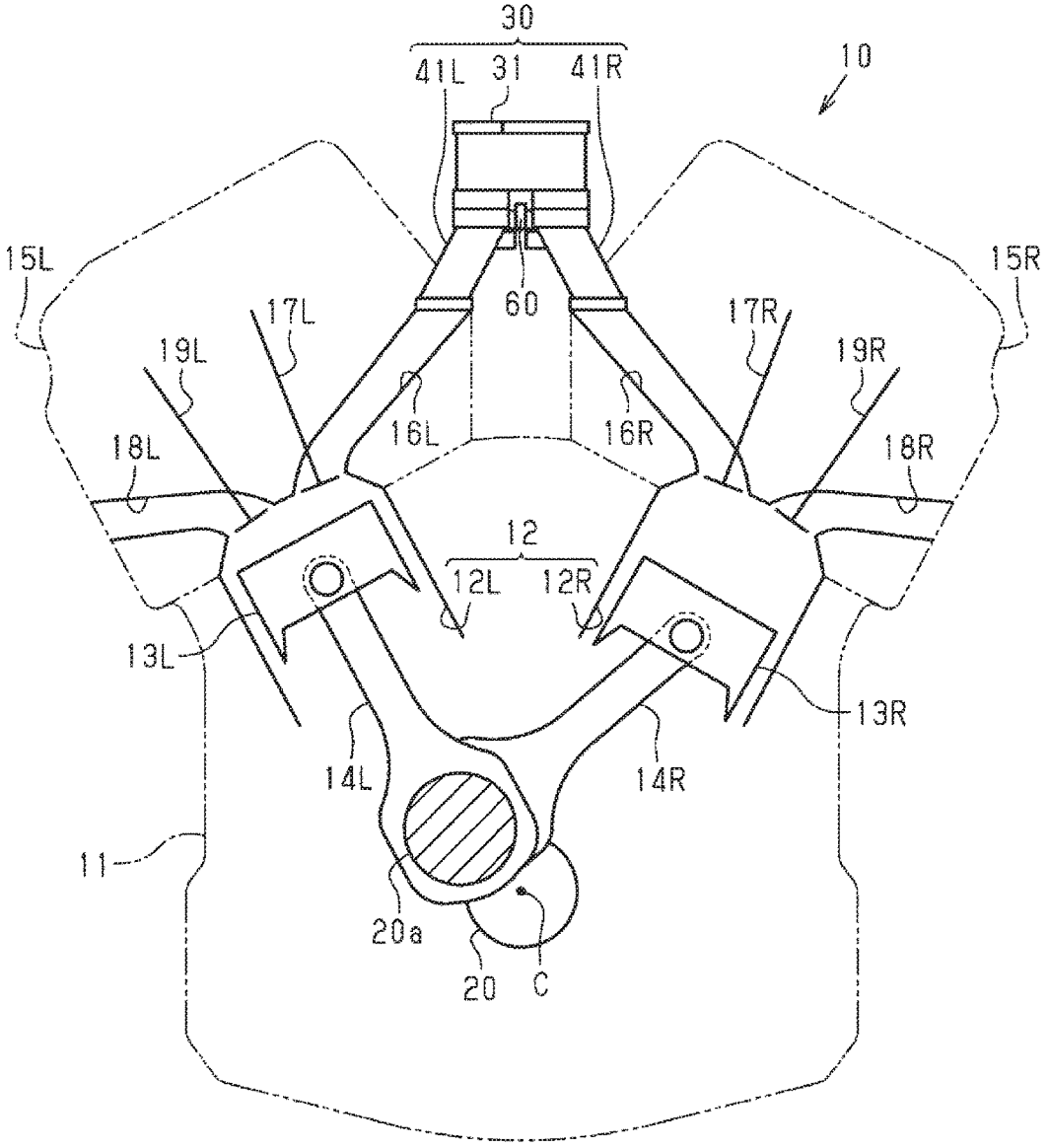
FIG. 1 is a schematic view of a structure of an internal combustion engine.

Hereinafter, an embodiment of an assembling structure for an intake manifold 30 according to the disclosure is described. First of all, a structure of an internal combustion engine 10 in which the intake manifold 30 is installed is described. As shown in FIG. 1, in a cylinder block 11 of the internal combustion engine 10, six cylinders 12 (only two of them are shown in FIG. 1) are provided. Out of the six cylinders 12, three of them are provided side by side on one side (the left side in FIG. 1) of a center of rotation C of a crankshaft 20 and structure first bank-side cylinders 12L. The remaining three cylinders 12 are provided side by side on the other side (the right side in FIG. 1) of the center of rotation C of the crankshaft 20 and structure second bank-side cylinders 12R. The first bank-side cylinders 12L and the second bank-side cylinders 12R are inclined so as to be closer to one another towards the crankshaft 20. This means that the internal combustion engine 10 is an internal combustion engine with the six cylinders arranged in a V shape.

A piston 13L is disposed inside each of the first bank-side cylinders 12L so that the piston 13L reciprocates inside the cylinder 12L. The piston 13L is connected with a crankpin 20*a* of the crankshaft 20 through a connecting rod 14L. Similarly, a piston 13R is disposed inside each of the second bank-side cylinders 12R so that the piston 13R reciprocates inside the cylinders 12R. The piston 13R is connected with the crankpin 20*a* of the crankshaft 20 through a connecting rod 14R. As the piston 13L on the first bank-side and the piston 13R on the second bank-side reciprocate, the crankshaft 20 rotates around the center of rotation C.

A first cylinder head 15L is mounted on an upper portion of the cylinder block 11 so that the first cylinder head 15L faces the first bank-side cylinders 12L. In the first cylinder head 15L, suction ports 16L are provided in order to supply intake air to the first bank-side cylinders 12L, respectively. The number of the suction ports 16L provided is three corresponding to the first bank-side cylinders 12L, respectively. In the first cylinder head 15L, intake valves 17L are provided in order to open and close openings of the suction ports 16L on the side of the cylinders 12L.

In the first cylinder head 15L, exhaust ports 18L are provided in order to discharge exhaust gas from the first bank-side cylinders 12L. The number of the exhaust ports 18L provided is three corresponding to the first bank-side cylinders 12L, respectively. In the first cylinder head 15L, exhaust valves 19L are also provided in order to open and close openings of the exhaust ports 18L on the side of the cylinders 12L.

A second cylinder head 15R is mounted on the upper portion of the cylinder block 11 so that the second cylinder head 15R faces the second bank-side cylinders 12R. In the second cylinder head 15R, suction ports 16R are provided in order to supply intake air to the second bank-side cylinders 12R, respectively. The number of the suction ports 16R provided is three corresponding to the second bank-side cylinders 12R. Further, in the second cylinder head 15R, intake valves 17R are provided in order to open and close openings of the suction ports 16R on the side of the cylinders 12R.

In the second cylinder head 15R, exhaust ports 18R are provided in order to discharge exhaust gas from the second bank-side cylinders 12R. The number of the exhaust ports 18R provided is three corresponding to the second bank-side cylinders 12R, respectively. In the second cylinder head 15R, exhaust valves 19R are also provided in order to open and close openings of the exhaust ports 18R on the side of the cylinders 12R.

Between the first cylinder head 15L and the second cylinder head 15R in the internal combustion engine 10, the intake manifold 30 is provided. The intake manifold 30 introduces intake air (outside air) from the outside of a vehicle into the suction ports 16L of the first cylinder head 15L and the suction ports 16R of the second cylinder head 15R.

Figure 2:
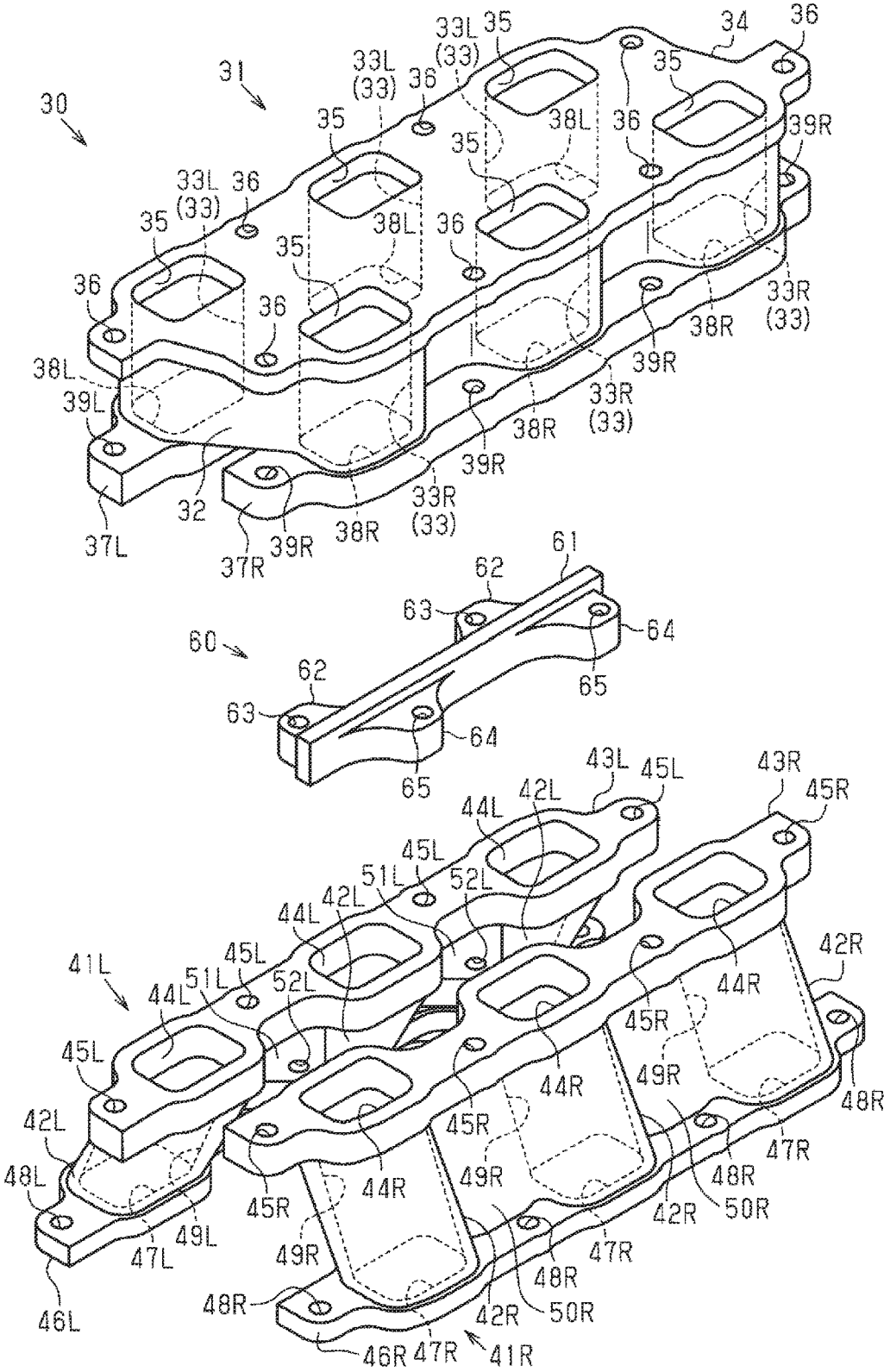
FIG. 2 is an exploded perspective view of an intake manifold.

Next, the intake manifold 30 and its assembling structure are described more specifically. As shown in FIG. 1 and FIG. 2, the intake manifold 30 includes an upstream portion 31 that structures a part of an upstream side of the intake airflow direction. The intake manifold 30 also includes a first downstream portion 41L and a second downstream portion 41R that are connected with a downstream side of the upstream portion 31. In the description below, as shown in FIG. 1 and FIG. 2, a side where the upstream portion 31 is located is referred to as an upper side, and a side where the first downstream portion 41L and the second downstream portion 41R are located is referred to as a lower side.

As shown in FIG. 2, the upstream portion 31 includes a flat block-shaped body portion 32. Six upstream passages 33 go through the body portion 32 in a thickness direction of the body portion 32. Out of the six upstream passages 33, three of them are disposed on a first side of a short direction of the body portion 32 and structure the first upstream passages 33L. The first upstream passages 33L are disposed side by side in a longitudinal direction of the body portion 32. The other three upstream passages 33 are disposed on a second side of the short direction of the body portion 32 and structure the second upstream passages 33R. The second upstream passages 33R are disposed side by side in the longitudinal direction of the body portion 32. Further, each of the second upstream passages 33R is disposed at a position shifted with respect to each of the first upstream passages 33L in the longitudinal direction of the body portion 32.

An almost plate-shaped upstream-side flange portion 34 is connected with an end surface of the body portion 32 on a first side in the thickness direction (an upstream side of the intake airflow direction). The upstream-side flange portion 34 is provided on the entire end surface of the body portion 32 on the first side in the thickness direction of the body portion 32. Further, a part of the upstream-side flange portion 34 reaches an outer side of an outer peripheral surface of the body portion 32. Six openings 35 go through the upstream-side flange portion 34 in a thickness direction. A shape of each of the openings 35 is the same as a passage sectional shape of each of the upstream passages 33 in the body portion 32. Also, arrangement of the openings 35 is the same as arrangement of the upstream passages 33 in the body portion 32. This means that each of the upstream passages 33 in the body portion 32 opens in the upstream portion 31 on the upstream side of the intake airflow direction through each of the openings 35 of the upstream-side flange portion 34.

Eight bolt holes 36 go through the upstream-side flange portion 34 in a thickness direction. Each of the bolt holes 36 is positioned in a portion of the upstream-side flange portion 34 on the outer side of the outer peripheral surface of the body portion 32. Thus, each of the bolt holes 36 does not communicate with the inside of each of the upstream passages 33. Bolts (not shown) are inserted in the bolt holes 36, respectively, and the bolts connect the upstream portion 31 (the intake manifold 30) with an intake air passage on a further upstream side, for example, a surge tank that is used to store intake air temporarily.

An almost plate-shaped first downstream-side flange portion 37L and an almost plate-shaped second downstream-side flange portion 37R are connected with an end surface of the body portion 32 on a second side in the thickness direction (a downstream side in the intake airflow direction). The first downstream-side flange portion 37L is positioned on the first side of the body portion 32 in the short direction (an upper left side in FIG. 2) and extends in the longitudinal direction of the body portion 32. A part of the first downstream-side flange portion 37L reaches the outer side of the outer peripheral surface of the body portion 32. Three openings 38L go through the first downstream-side flange portion 37L in a thickness direction. A shape of each of the openings 38L is the same as a passage sectional shape of each of the first upstream passages 33L in the body portion 32. Further, arrangement of the openings 38L is the same as arrangement of the first upstream passages 33L in the body portion 32. This means that each of the first upstream passages 33L in the body portion 32 opens in the upstream portion 31 on a downstream side of the intake airflow direction through each of the openings 38L in the first downstream-side flange portion 37L. Four bolt holes 39L go through the first downstream-side flange portion 37L in the thickness direction. Each of the bolt holes 39L is positioned in a portion of the first downstream-side flange portion 37L on the outer side of the outer peripheral surface of the body portion 32.

The second downstream-side flange portion 37R is positioned on the second side of the body portion 32 in the short direction (a lower right side in FIG. 2), and extends in the longitudinal direction of the body portion 32. Further, a part of the second downstream-side flange portion 37R reaches the outer side of the outer peripheral surface of the body portion 32. Three openings 38R go through the second downstream-side flange portion 37R in a thickness direction. A shape of each of the openings 38R is the same as the passage sectional shape of each of the second upstream passages 33R in the body portion 32. Further, arrangement of the openings 38R is the same as arrangement of the second upstream passages 33R in the body portion 32. This means that each of the second upstream passages 33R in the body portion 32 opens in the upstream portion 31 on the downstream side of the intake airflow direction through each of the openings 38R of the second downstream-side flange portion 37R. Four bolt holes 39R go through the second downstream-side flange portion 37R in the thickness direction. Each of the bolt holes 39R is positioned in a portion of the second downstream-side flange portion 37R on the outer side of the outer peripheral surface of the body portion 32.

The first downstream portion 41L of the intake manifold 30 includes three first cylindrical bodies 42L each having a rectangular cylindrical shape. Internal space of each of the first cylindrical bodies 42L structures the first downstream passage 49L. The first cylindrical bodies 42L are provided side by side so as to align with the three first upstream passages 33L in the upstream portion 31, respectively. The first cylindrical bodies 42L are inclined with respect to an upper-lower direction so that the first cylindrical bodies 42L are directed to an outer side of a short direction of the body portion 32 towards the downstream side of the intake airflow direction.

An almost plate-shaped first upper flange 43L is connected with upper end surfaces of the first cylindrical bodies 42L. The first upper flange 43L extends so as to link the upper end surfaces of the three first cylindrical bodies 42L. Three openings 44L go through the first upper flange 43L in a thickness direction. A shape of each of the openings 44L is the same as a passage sectional shape of the first cylindrical body 42L. Further, arrangement of the openings 44L is the same as arrangement of the first cylindrical bodies 42L. Thus, the first downstream passages 49L of the first downstream portion 41L communicate with the first upstream passages 33L of the body portion 32 through the openings 44L of the first upper flange 43L, respectively. Four bolt holes 45L go through the first upper flange 43L in the thickness direction. Positions of the bolt holes 45L correspond to positions of the bolt holes 39L of the first downstream-side flange portion 37L in the upstream portion 31. As a bolt (not shown) is inserted in each of the bolt holes 45L and each of the bolt holes 39L, the first downstream portion 41L is fixed to the upstream portion 31.

An almost plate-shaped first lower flange 46L is connected with a lower end surface of the first cylindrical body 42L. The first lower flange 46L extends so as to link lower end surfaces of the three first cylindrical bodies 42L. Three openings 47L go through the first lower flange 46L in a thickness direction. A shape of each of the openings 47L is the same as the passage sectional shape of each of the first cylindrical bodies 42L. Further, arrangement of the openings 47L are the same of arrangement of the first cylindrical bodies 42L. This means that the first downstream passages 49L of the first downstream portion 41L are open in the first downstream portion 41L on the intake air downstream side through the openings 47L of the first lower flange 46L, respectively. Further, four bolt holes 48L go through the first lower flange 46L in a thickness direction. A bolt (not shown) is inserted in each of the bolt holes 48L, and the first downstream portion 41L is fixed to the first cylinder head 15L by the bolts.

Figure 3:
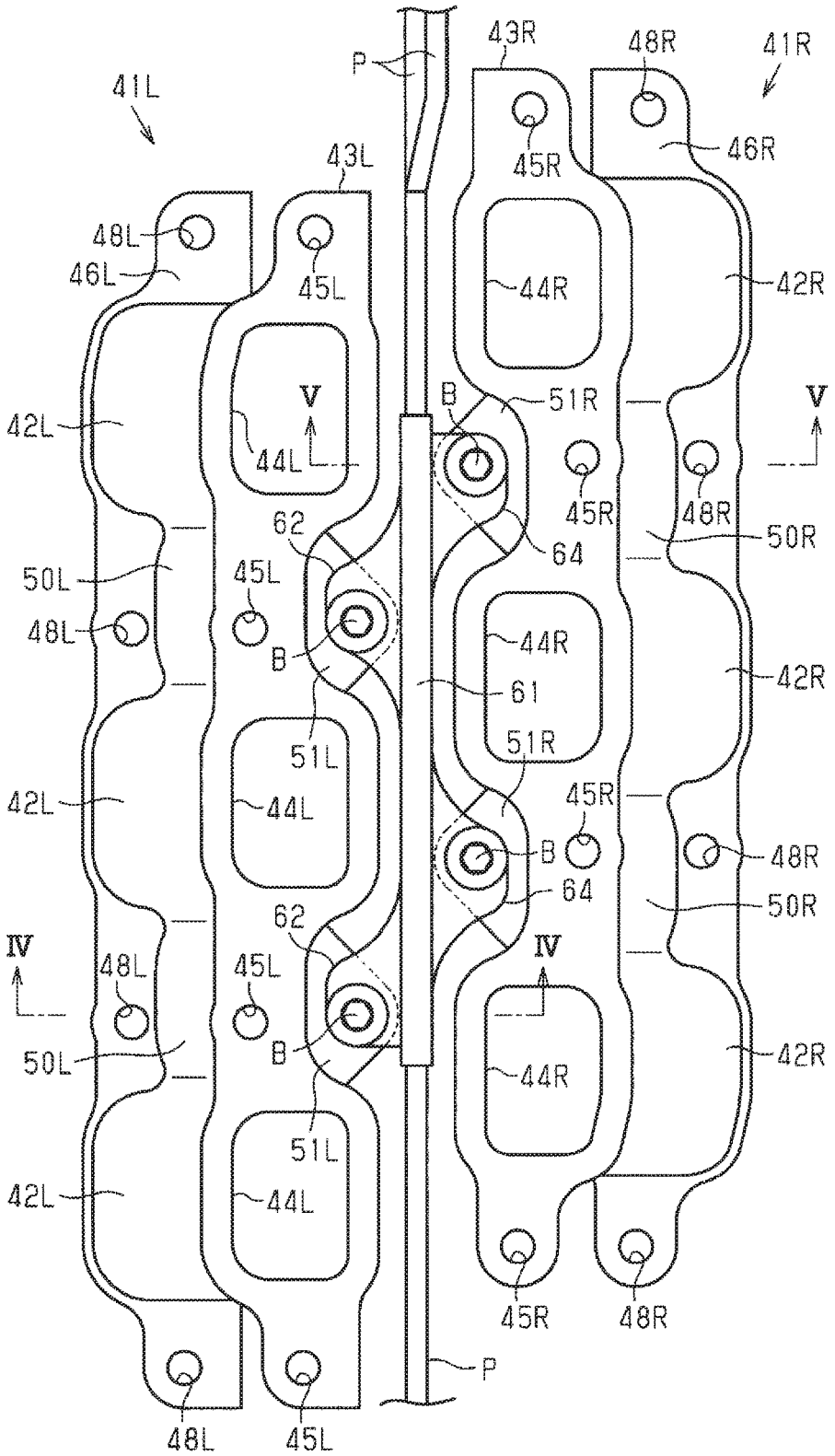
FIG. 3 is a top view of a first downstream portion, a second downstream portion, and a connecting member.

As shown in FIG. 3, the two neighboring first cylindrical bodies 42L are connected with each other by a first intermediate wall portion 50L. The first intermediate wall portion 50L extends along an extending direction of the first cylindrical bodies 42L from the first lower flange 46L to the first upper flange 43L. This means space between the neighboring two first cylindrical bodies 42L is closed by the first intermediate wall portion 50L.

Figure 4:
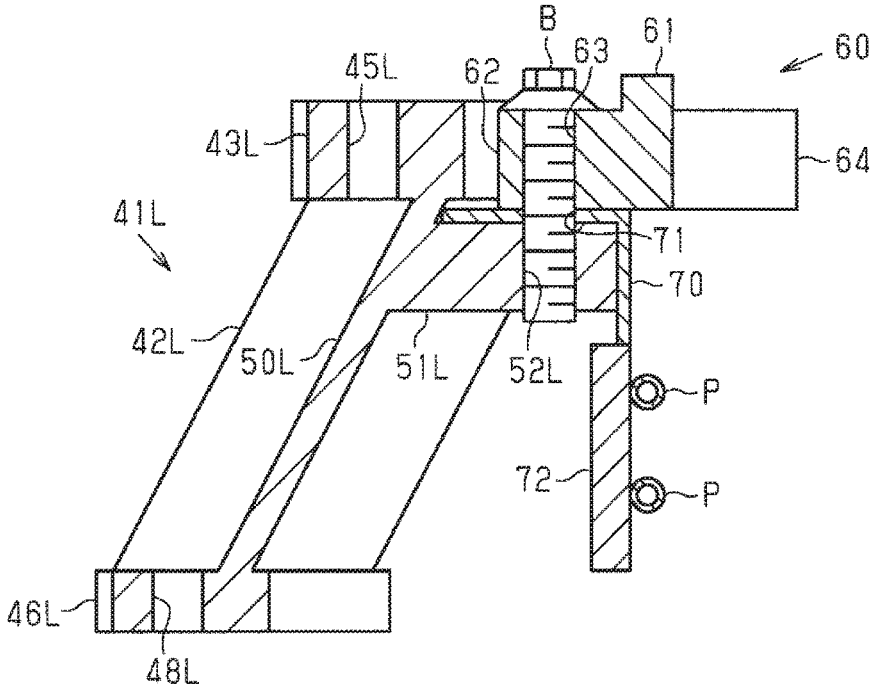
FIG. 4 is a sectional view taken along the line IV-IV in FIG. 3.

As shown in FIG. 4, a first fixing plate 51L projects towards the second downstream portion 41R side from a surface of the first intermediate wall portion 50L on the side of the second downstream portion 41R (the right side in FIG. 4). The first fixing plate 51L has a plate shape and extends almost in parallel to the first upper flange 43L. As shown in FIG. 3, the first fixing plate 51L has a tapered shape in a top view, and is in a triangular shape as a whole in a plan view. As shown in FIG. 4, a bolt hole 52L goes through a projecting distal end portion of the first fixing plate 51L in a thickness direction of the first fixing plate 51L.

The second downstream portion 41R of the intake manifold 30 includes three second cylindrical bodies 42R each having an almost rectangular cylindrical shape. Internal space of each of the second cylindrical bodies 42R forms a second downstream passage 49R. The second cylindrical bodies 42R are provided side by side so as to align with the three second upstream passages 33R in the upstream portion 31, respectively. The second cylindrical bodies 42R are inclined with respect to the upper-lower direction so that the second cylindrical bodies 42R are directed to an outer side of the short direction of the body portion 32 towards the downstream side of the intake airflow direction.

An almost plate-shaped second upper flange 43R is connected with an upper end surface of the second cylindrical bodies 42R. The second upper flange 43R extends so as to link the upper end surfaces of the three second cylindrical bodies 42R. Three openings 44R go through the second upper flange 43R in a thickness direction. A shape of each of the openings 44R is the same as the passage sectional shape of each of the second cylindrical bodies 42R. Further, arrangement of the openings 44R is the same as arrangement of the second cylindrical bodies 42R. This means that the second downstream passages 49R of the second downstream portion 41R communicate with the second upstream passages 33R of the body portion 32 through the openings 44R of the second upper flange 43R, respectively. Four bolt holes 45R go through the second upper flange 43R in the thickness direction. A position of each of the bolt holes 45R corresponds to a position of each of the bolt holes 39R of the second downstream-side flange portion 37R in the upstream portion 31. As a bolt (not shown) is inserted in each of the bolt holes 45R and each of the bolt holes 39R, the second downstream portion 41R is fixed to the upstream portion 31.

An almost plate-shaped second lower flange 46R is connected with lower end surfaces of the second cylindrical bodies 42R. The second lower flange 46R extends so as to link the lower end surfaces of the three second cylindrical bodies 42R. Three openings 47R go through the second lower flange 46R in a thickness direction. A shape of each of the openings 47R is the same as the passage sectional shape of the second cylindrical body 42R. Further, arrangement of the openings 47R is the same as arrangement of the second cylindrical bodies 42R. This means that the second downstream passages 49R of the second downstream portion 41R are open in the second downstream portion 41R on the intake air downstream side through the openings 47R of the second lower flange 46R, respectively. Four bolt holes 48R go through the second lower flange 46R in the thickness direction. As a bolt (not shown) is inserted in each of the bolt holes 48R, the second downstream portion 41R is fixed to the second cylinder head 15R by the bolts.

As shown in FIG. 3, the two neighboring second cylindrical bodies 42R are connected with one another by a second intermediate wall portion 50R. The second intermediate wall portion 50R extends in an extending direction of the second cylindrical bodies 42R from the second lower flange 46R to the second upper flange 43R. Thus, space between the neighboring two second cylindrical bodies 42R is closed by the second intermediate wall portion 50R.

Figure 5:
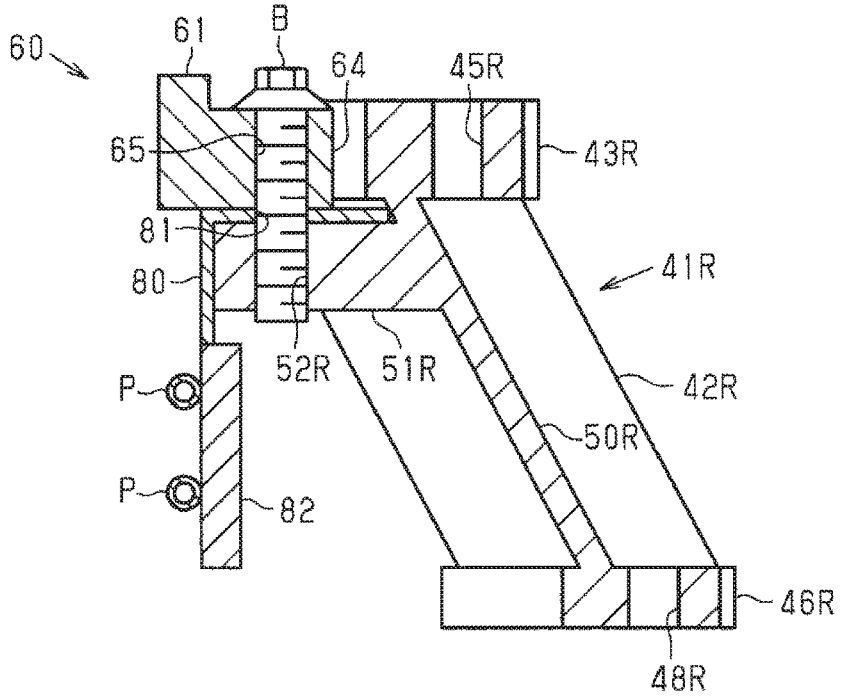
FIG. 5 is a sectional view taken along the line V-V in FIG. 3.

As shown in FIG. 5, a second fixing plate 51R projects towards the first downstream portion 41L from a surface of the second intermediate wall portion 50R on the side of the first downstream portion 41L (the left side in FIG. 5). The second fixing plate 51R has a plate shape and extends almost in parallel to the second upper flange 43R. As shown in FIG. 3, the second fixing plate 51R has a tapered shape in a top view, and is in a triangular shape as a whole in a plan view. As shown in FIG. 5, a bolt hole 52R goes through a projecting distal end portion of the second fixing plate 51R in a thickness direction of the second fixing plate 51R.

As shown in FIG. 2 and FIG. 3, the first downstream portion 41L and the second downstream portion 41R are connected with each other by a connecting member 60. The connecting member 60 includes a central portion 61 having an almost quadrangular prism shape. First fixing portions 62 project from a side surface of the central portion 61 on a first side in a short direction. Each of the first fixing portions 62 has a plate shape, and is in a tapered shape in a top view. As shown in FIG. 4, a bolt hole 63 goes through a projecting distal end portion of the first fixing portion 62 in a thickness direction of the first fixing portion 62. As shown in FIG. 3, two of the first fixing portions 62 are provided side by side in the longitudinal direction of the central portion 61. A distance between the two first fixing portions 62 coincides with a distance between two first fixing plates 51L of the first downstream portion 41L. A distance between the bolt holes 63 of the two first fixing portions 62 coincides with a distance between the bolt holes 52L of the two first fixing plates 51L.

As shown in FIG. 2 and FIG. 3, second fixing portions 64 project from a side surface of the central portion 61 on a second side in the short direction. Each of the second fixing portions 64 has a plate shape, and is in a tapered shape in a top view. As shown in FIG. 5, a bolt hole 65 goes through a projecting distal end portion of the second fixing portion 64 in a thickness direction of the second fixing portion 64. As shown in FIG. 3, two of the second fixing portions 64 are provided side by side in the longitudinal direction of the central portion 61. A position of each of the second fixing portions 64 is shifted from a position of each of the first fixing portions 62 in the longitudinal direction of the central portion 61. A shifted distance of the second fixing portion 64 from the first fixing portion 62 coincides with a shifted distance of the first upstream passage 33L and the second upstream passage 33R of the upstream portion 31. This means that the shifted distance of the second fixing portion 64 from the first fixing portion 62 is set to meet a positional relation between the first downstream portion 41L and the second downstream portion 41R. An interval between the two second fixing portions 64 coincides with an interval between the two second fixing plates 51R in the second downstream portion 41R. Further, an interval between the bolt holes 65 of the two second fixing portions 64 coincides with an interval between the bolt holes 52R of the two second fixing plates 51R.

As shown in FIG. 3, each of the first fixing portions 62 of the connecting member 60 is positioned on an upper side of each of the first fixing plates 51L of the first downstream portion 41L. Further, each of the second fixing portions 64 of the connecting member 60 is positioned on an upper side of each of the second fixing plates 51R of the second downstream portion 41R. Then, as shown in FIG. 4, a bolt B is inserted in the bolt hole 63 of each of the first fixing portions 62 of the connecting member 60 and the bolt hole 52L in each of the first fixing plates 51L of the first downstream portion 41L. Thus, the connecting member 60 is fixed to the first downstream portion 41L. Further, as shown in FIG. 5, the bolt B is inserted in the bolt hole 65 of each of the second fixing portions 64 of the connecting member 60 and the bolt hole 52R of each of the second fixing plates 51R of the second downstream portion 41R. Thus, the connecting member 60 is fixed to the second downstream portion 41R.

As shown in FIG. 4, a first stay 70 is interposed in one of two fixed places between the first fixing portions 62 of the connecting member 60 and the first fixing plates 51L of the first downstream portion 41L (in the embodiment, the fixed place on the lower side in FIG. 3). The first stay 70 is used to fix purge pipes P to the intake manifold 30. Specifically, the first stay 70 has a plate shape that is bent at a right angle. A thickness of the first stay 70 is smaller than the thickness of the first upper flange 43L of the first downstream portion 41L and the thickness of the first fixing portion 62 of the connecting member 60. A bolt hole 71 goes through the first stay 70 on one side of a bent portion in a thickness direction of the first stay 70. In the first stay 70, a flat-plate portion on the side where the bolt hole 71 is provided is sandwiched between the first fixing portion 62 of the connecting member 60 and the first fixing plate 51L of the first downstream portion 41L. Further, the bolt B that is inserted in the bolt hole 63 of the first fixing portion 62 of the connecting member 60 and the bolt hole 52L in the first fixing plate 51L of the first downstream portion 41L is inserted in the bolt hole 71 of the first stay 70. This means that the first stay 70 is fastened by the bolt B together with the first fixing portion 62 of the connecting member 60 and the first fixing plate 51L of the first downstream portion 41L in a state where the first stay 70 is interposed between the first fixing portion 62 and the first fixing plate 51L.

An end portion of the first stay 70 on the side where the first stay 70 is not sandwiched between the first fixing portion 62 of the connecting member 60 and the first fixing plate 51L of the first downstream portion 41L is directed downward. A plate-shaped support plate 72 that is thicker than the first stay 70 is fixed to an end portion of the first stay 70 on the lower side. An upper end portion of the support plate 72 is connected with the end portion of the first stay 70, and the support plate 72 is disposed along the upper-lower direction. The purge pipes P are fixed to a surface of the support plate 72 on the side of the second downstream portion 41R (the surface on the right side in FIG. 4). The purge pipes P are used to lead evaporated fuel to an intake system of the internal combustion engine. The purge pipes P are fixed to the support plate 72 by welding. In the embodiment, the two purge pipes P are disposed side by side vertically, and extend along the longitudinal direction of the connecting member 60 (the central portion 61). In FIG. 1 and FIG. 2, the first stay 70, the support plate 72, and the purge pipes P are not shown.

As shown in FIG. 5, a second stay 80 is interposed in one of two fixed places between the second fixing portions 64 of the connecting member 60 and the second fixing plates 51R of the second downstream portion 41R. The second stay 80 is used to fix the purge pipes P to the intake manifold 30. In the embodiment, out of the two fixed places of the second fixing portions 64 of the connecting member 60 and the second fixing plates 51R of the second downstream portion 41R, the second stay 80 is interposed in the fixed place on a far side from the first stay 70 (the fixed place on the upper side in FIG. 3). Specifically, the second stay 80 has a plate shape that is bent at a right angle. A thickness of the second stay 80 is smaller than the thickness of the second upper flange 43R of the second downstream portion 41R and the thickness of the second fixing portion 64 of the connecting member 60. A bolt hole 81 goes through the second stay 80 on one side of a bent portion in a thickness direction of the second stay 80. A flat-plate portion of the second stay 80 on the side where the bolt hole 81 is provided is sandwiched between the second fixing portion 64 of the connecting member 60 and the second fixing plate 51R of the second downstream portion 41R. Further, the bolt B that is inserted in the bolt hole 65 of the second fixing portion 64 of the connecting member 60, and the bolt hole 52R of the second fixing plate 51R of the second downstream portion 41R is inserted in the bolt hole 81 of the second stay 80. This means that the second stay 80 is fastened by the bolt B together with the second fixing portion 64 of the connecting member 60 and the second fixing plate 51R of the second downstream portion 41R in a state where the second stay 80 is interposed between the second fixing portion 64 and the second fixing plate 51R.

An end portion of the second stay 80 on the side where the second stay 80 is not sandwiched between the second fixing portion 64 of the connecting member 60 and the second fixing plate 51R of the second downstream portion 41R is directed downward. A plate-shaped support plate 82 that is thicker than the second stay 80 is fixed to an end portion of the second stay 80 on the lower side. An upper end portion of the support plate 82 is connected with the end portion of the second stay 80, and the support plate 82 is disposed along the upper-lower direction. The purge pipes P are fixed to a surface of the support plate 82 on the side of the first downstream portion 41L (a surface on the left side in FIG. 5). The purge pipes P are fixed to the support plate 82 by welding. In FIG. 1 and FIG. 2, the second stay 80 and the support plate 82 are not shown.

In the embodiment, the first stay 70 is not interposed in the other one of the two fixed places between the first fixing portions 62 of the connecting member 60 and the first fixing plates 51L of the first downstream portion 41L (the fixed place on the upper side in FIG. 3). Similarly, the second stay 80 is not interposed in the other one of the two fixed places between the second fixing portions 64 of the connecting member 60 and the second fixing plates 51R of the second downstream portion 41R (the fixed place on the lower side in FIG. 3).

In the intake manifold 30 structured as described above, a material of the upstream portion 31 is an aluminum alloy. The aluminum alloy herein means an aluminum-based alloy that is referred to as, for example, anticorrosion aluminum, duralumin, super duralumin, and extra-super duralumin. Further, a material of the first downstream portion 41L, the second downstream portion 41R, and the connecting member 60 is cast iron. Cast iron herein means an iron-based alloy with a carbon content of over 2.1% and a silicon content of 1% to 3%. All of the upstream portion 31, the first downstream portion 41L, the second downstream portion 41R, and the connecting member 60 are formed by casting where a mold is filled with molten metal.

Young's modulus (modulus of longitudinal elasticity) of an aluminum alloy used to structure the upstream portion 31 is around 70 GPa. Meanwhile, Young's modulus of cast iron used to structure the first downstream portion 41L and the second downstream portion 41R is about 150 GPa. Therefore, the first downstream portion 41L and the second downstream portion 41R are made from a material having higher rigidity (larger Young's modulus) than that of the upstream portion 31.

A material of the first stay 70 and the second stay 80 that are used to fix the purge pipes P to the intake manifold 30 is carbon steel. Carbon steel herein means an iron-based alloy with a carbon content of about 0.02% to 2.1%. The first stay 70 and the second stay 80 are formed in a forging method in which pressure is applied to make a shape by, for example, hammering with a jig and so on.

Actions and effects of the embodiment are described. In the internal combustion engine 10 according to the embodiment, when vibration is transmitted to the intake manifold 30 from the first cylinder head 15L and the second cylinder head 15R, force is applied that separates a downstream end of the first downstream portion 41L and a downstream end of the second downstream portion 41R from each other. Then, creaking and so on can happen in connecting parts between the first downstream portion 41L and the second downstream portion 41R, and the upstream portion 31, and so on. This can be a cause of abnormal sound and noise.

In the embodiment, the material for the first downstream portion 41L and the second downstream portion 41R are made from cast iron with relatively high rigidity, and the first downstream portion 41L and the second downstream portion 41R are connected with each other by the connecting member 60 that is also made from cast iron. Therefore, deformation of the intake manifold 30 that separates the downstream end of the first downstream portion 41L and the downstream end of the second downstream portion 41R from each other is restrained. As a result, generation of abnormal sound and noise is restrained.

Incidentally, the first downstream portion 41L, the second downstream portion 41R, and the connecting member 60 are all formed by casting, and manufacturing errors in dimension and shape are relatively large. Further, since the rigidity of the connecting member 60 is relatively high, deformation of the connecting member 60 is not expected to absorb manufacturing errors in shape and dimension of the first downstream portion 41L, the second downstream portion 41R, and the connecting member 60. Thus, when the connecting member 60 is assembled to the first downstream portion 41L and the second downstream portion 41R by using the bolts B, the assembly may be difficult, and rattling and so on are likely to happen even when the assembly is done.

Specifically, even when an upper surface of the first fixing plate 51L of the first downstream portion 41 is designed to have a perfectly level flat surface, the first downstream portion 41L manufactured by casting can cause slight distortion and unevenness in the upper surface of the first fixing plate 51L. Also, when slight manufacturing errors in dimension happen to the first downstream portion 41L, the positional relation with the second downstream portion 41R is also slightly changed. Similarly, a lower surface of the first fixing portion 62 of the connecting member 60 can have slight distortion and unevenness or slight dimension errors. When the first downstream portion 41L and the connecting member 60 are assembled to each other by using the bolts B in the state where there are errors in shape and dimension in the first downstream portion 41L and the connecting member 60 as described above, more force is necessary than assumed in order to screw the bolts B, thus causing deterioration of assembly performance. Even when it is possible to assemble the first downstream portion 41L and the connecting member 60 to each other by the bolts B, the bolts B may not be screwed completely, and rattling can happen between the first downstream portion 41L and the connecting member 60.

In this regard, in the embodiment, the plate-shaped first stay 70 is interposed between the first fixing plate 51L of the first downstream portion 41L and the first fixing portion 62 of the connecting member 60. Slight flexure and unevenness happen to the first stay 70 while, for example, the bolt hole 71 is being formed or the first stay 70 is being bent at an almost right angle. Then, the flexure and unevenness of the first stay 70 are deformed following the shape and dimension changes of the first fixing plate 51L of the first downstream portion 41L and the first fixing portion 62 of the connecting member 60. Thus, the first stay 70 functions as a washer and is able to absorb the manufacturing errors in shape and dimension of the first downstream portion 41L and the connecting member 60. Therefore, it is possible to restrain deterioration of assembly performance of the connecting member 60 and the first downstream portion 41L and rattling that happens after the assembly. Moreover, the first stay 70 is necessary in order to fix the purge pipes P to the intake manifold 30. Thus, in the embodiment, the member for fixing the purge pipes P also has a function that restrains deterioration of assembly performance, and so on. Hence, it is not necessary to add a new member just to restrain deterioration of assembly performance and so on of the connecting member 60 and so on, and it is thus possible to minimize increases in the number of parts and assembly man-hours, and so on. The series of actions and effects are the same for the second downstream portion 41R, the connecting member 60, and the second stay 80.

In the embodiment, the connecting member 60 is fixed to the first downstream portion 41L at two places, and is also fixed to the second downstream portion 41R at two places. When there are dimensional errors in the first downstream portion 41L and the second downstream portion 41R, the two fixed places that are the farthest from one another, out of the total four fixed places, are affected most by the dimensional errors. In the embodiment, the first stay 70 and the second stay 80 are interposed at the two fixed places that are the farthest from one another among the four fixed places. Therefore, without interposing stays in all of the fixed places, the first stay 70 and the second stay 80 are able to absorb dimensional errors sufficiently, thereby restraining deterioration of assembly performance, rattling after assembly, and so on in a favorable manner.

In the embodiment, the first stay 70 is interposed between the first downstream portion 41L and the connecting member 60. Therefore, the first stay 70 is fixed to the intake manifold 30 with appropriate strength. Similarly, the second stay 80 is fixed to the intake manifold 30 with appropriate strength. Thus, the purge pipes P fixed to the intake manifold 30 through the first stay 70 and the second stay 80 are also fixed to the intake manifold 30 with appropriate strength. Fixing long members like the purge pipes P to the intake manifold 30 by using a strong structure that fixes the first downstream portion 41L and the second downstream portion 41R to the connecting member 60 is highly preferred in terms of restraining vibration and flexure of the purge pipes P.

The embodiment may be modified as follows and carried out. The embodiment and modified examples below may be combined with each other and carried out unless there is technical inconsistency. In the internal combustion engine 10 to which the intake manifold 30 is applied, the number of the cylinders 12 is not limited to six. The number of the cylinders 12 may be four, eight, twelve, and so on as long as the internal combustion engine 10 is a V-shaped internal combustion engine having the first bank-side cylinders 12L and the second bank-side cylinders 12R. When the number of the cylinders 12 of the internal combustion engine 10 is changed, the number of the upstream passages 33 of the upstream portion 31 and the number of the first downstream passages 49L (the first cylindrical bodies 42L) of the first downstream portion 41L and the second downstream passages 49R (the second cylindrical bodies 42R) of the second downstream portion 41R may be changed accordingly.

The first downstream portion 41L and the second downstream portion 41R may not be connected with the upstream portion 31 directly. This means that, as long as a communication relation between the first downstream passages 49L of the first downstream portion 41L and the first upstream passages 33L the upstream portion 31, and a communication relation between the second downstream passages 49R of the second downstream portion 41R and the second upstream passages 33R of the upstream portion 31 are maintained, another passage structural member may be interposed between the first downstream portion 41L and the second downstream portion 41R, and the upstream portion 31. Thus, even when another passage structural member is interposed between the first downstream portion 41L and the second downstream portion 41R, and the upstream portion 31, the upstream portion 31 is connected with the upstream sides of the first downstream portion 41L and the second downstream portion 41R in the intake airflow direction.

The entire shape (an outside shape) of the intake manifold 30 is not limited to the example described in the embodiment. The shape may be changed as appropriate in accordance with arrangement and inclination angle (an angle of the V shape) of the cylinders 12 of the internal combustion engine 10, the shapes of the first cylinder head 15L and the second cylinder head 15R, and so on.

A material of the first downstream portion 41L, the second downstream portion 41R, and the upstream portion 31 is not limited to the example described in the embodiment. For example, the same material may be used for the first downstream portion 41L, the second downstream portion 41R, and the upstream portion 31. The material is not limited to an aluminum alloy and cast iron, and may be carbon steel (steel), resin, and so on.

A material of the connecting member 60 may be changed appropriately. For example, the material of the connecting member 60 may be aluminum alloy, carbon steel, or resin. Further, the material of the connecting member 60 does not need to be the same as the material of the first downstream portion 41L and the second downstream portion 41R. The connecting member 60 is a member that restrains deformation of the first downstream portion 41L and the second downstream portion 41R that causes them to be separated from each other. From these viewpoints, it is preferred that the material of the connecting member 60 has rigidity that is about the same as or higher than rigidity of the material of the first downstream portion 41L and the second downstream portion 41R.

The method for connecting the first downstream portion 41L and the second downstream portion 41R with the upstream portion 31 is not limited to fixing using bolts. For example, when all of the first downstream portion 41L, the second downstream portion 41R, and the upstream portion 31 are made from metal, they may be connected with each other by welding. Further, the first downstream portion 41L and the second downstream portion 41R may be connected (brazed) with the upstream portion 31 by using an adhesive. Moreover, when the first downstream portion 41L, the second downstream portion 41R, and the upstream portion 31 are all made from synthetic resin, welding such as laser welding may be used to connect them.

Either one of the first stay 70 and the second stay 80 in the embodiment may be omitted. In other words, out of the total four fixed places, which include the two fixed places between the first downstream portion 41L and the connecting member 60, and the two fixed places between the second downstream portion 41R and the connecting member 60, the stay needs to be interposed at least one of the fixed places only.

The first stays 70 may be interposed in both of the two fixed places between the first downstream portion 41L and the connecting member 60, respectively. Similarly, the second stays 80 may be interposed in both of the two fixed places between the second downstream portion 41R and the connecting member 60, respectively. Whether to interpose the stay in each of the fixed places may be determined while finding a good balance among fixing strength required for the purge pipes P, cost incurred due to an increase in the number of parts, and an increase in assembly man-hours.

Out of the total four fixed places between the first downstream portion 41L and the second downstream portion 41R, and the connecting member 60, in the fixed places where the first stay 70 and the second stay 80 are not interposed, the bolt holes 63, 65 of the connecting member 60 may have inner diameters slightly larger than those of the remaining bolt holes 63, 65. In the fixed places where the first stay 70 and the second stay 80 are not interposed, it is not possible to absorb manufacturing errors in shape and dimension by using deformation of the stays. Thus, as described above, by slightly increasing the inner diameters of the bolt holes 63, 65, slight misalignment between the first downstream portion 41L and the second downstream portion 41R, and the connecting member 60 due to the manufacturing errors is allowed. Even in this case, the first downstream portion 41L and the second downstream portion 41R, and the connecting member 60 are strongly fixed to each other at the fixed places where the first stay 70 and the second stay 80 are interposed, and the first downstream portion 41L, the second downstream portion 41R, and the connecting member 60 are thus restrained from rattling.

The first stay 70 and the second stay 80 are not limited to those used for fixing the purge pipes P to the intake manifold 30. Any type of pipe may be fixed to the first stay 70 and the second stay 80 as long as the pipe allows a fluid to flow, such as a fuel pipe, a pipe for coolant for the internal combustion engine 10, and a pipe for window washer liquid. Different pipes may be fixed to the first stay 70 and the second stay 80, respectively.

The first stay 70 and the second stay 80 may be used to fix not only a pipe but also an other member. For example, the first stay 70 and the second stay 80 may be used for fixing a head cover that covers the first cylinder head 15L and the second cylinder head 15R. The first stay 70 and the second stay 80 may be fixed to a mount member that is used to connect the intake manifold 30 (the internal combustion engine 10) to a vehicle skeleton (a side member and a suspension member).

The shapes of the first stay 70 and the second stay 80 may be changed as appropriate as long as they are plate shapes that are deformed more easily than the first downstream portion 41L and the second downstream portion 41R. The first stay 70 and the second stay 80 may be designed in accordance with a shape and arrangement of the other member to be fixed by the first stay 70 and the second stay 80.

What is claimed is:

1. An assembling structure for an intake manifold that is provided between a first cylinder head on a first bank-side and a second cylinder head on a second bank-side in a V-shaped internal combustion engine and is configured to supply intake air from outside to a first suction port of the first cylinder head and a second suction port of the second cylinder head, the assembling structure comprising:

a first downstream portion including a first downstream passage connected with the first suction port, the first downstream portion being connected with the first cylinder head;

a second downstream portion including a second downstream passage connected with the second suction port, the second downstream portion being connected with the second cylinder head;

an upstream portion including a first upstream passage and a second upstream passage, the upstream portion being connected with upstream sides of the first downstream portion and the second downstream portion in an intake airflow direction, the first upstream passage communicating with the first downstream passage, the second upstream passage communicating with the second downstream passage;

a connecting member that connects the first downstream portion and the second downstream portion with each other; and a plate-shaped stay, wherein the connecting member is fixed to the first downstream portion and the second downstream portion by a bolt, and an other member that is a member other than the intake manifold is fixed to the intake manifold through the stay at least either between the connecting member and the first downstream portion, or between the connecting member and the second downstream portion.

2. The assembling structure according to claim 1 wherein the stay includes a first stay and a second stay, the connecting member and the first downstream portion are fixed to each other at a plurality of places, the connecting member and the second downstream portion are fixed to each other at a plurality of places, the first stay is interposed at one of the fixed places between the connecting member and the first downstream portion, and the second stay is interposed at the fixed place between the connecting member and the second downstream portion, and the second stay is disposed at the fixed place that is the farthest from the first stay.

3. The assembling structure according to claim 1, wherein:

a material of the first downstream portion and the second downstream portion has higher rigidity than that of a material of the upstream portion; and a material of the connecting member is the same as the material of the first downstream portion and the second downstream portion.

4. The assembling structure according to claim 1, wherein the other member is a purge pipe that introduces evaporated fuel to an intake system of the internal combustion engine.

5. The assembling structure according to claim 1, wherein the upstream side in the intake airflow direction is one side of a thickness direction of the intake manifold.

* * * * *